US009070490B2

(12) United States Patent
Shiroki et al.

(10) Patent No.: US 9,070,490 B2
(45) Date of Patent: Jun. 30, 2015

(54) FLAT CABLE AND ELECTRONIC APPARATUS

(71) Applicant: Murata Manufacturing Co., Ltd., Nagaokakyo, Kyoto-fu (JP)

(72) Inventors: Koji Shiroki, Nagaokakyo (JP); Yoichi Saito, Nagaokakyo (JP); Hiromasa Koyama, Nagaokakyo (JP); Hirotaka Fujii, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 217 days.

(21) Appl. No.: 13/928,720

(22) Filed: Jun. 27, 2013

(65) Prior Publication Data

US 2014/0003007 A1 Jan. 2, 2014

(30) Foreign Application Priority Data

Jun. 29, 2012 (JP) ..... 2012-147866
Mar. 28, 2013 (JP) ..... 2013-068343

(51) Int. Cl.

| | |
|---|---|
| ***H01B 7/08*** | (2006.01) |
| ***H01P 3/08*** | (2006.01) |
| *H01P 3/06* | (2006.01) |

(52) U.S. Cl.
CPC *H01B 7/08* (2013.01); *H01P 3/085* (2013.01); *H01P 3/06* (2013.01)

(58) Field of Classification Search
CPC ..... H01B 7/08; H01P 3/06; H01P 3/085
See application file for complete search history.

(56) References Cited

FOREIGN PATENT DOCUMENTS

| | | |
|---|---|---|
| JP | 3173143 U | 1/2012 |
| WO | 2011/007660 A1 | 1/2011 |

*Primary Examiner* — Jeremy C Norris
(74) *Attorney, Agent, or Firm* — Keating & Bennett, LLP

(57) ABSTRACT

A transmission line portion of a flat cable that is bent at a position along the longitudinal direction includes a dielectric element body, a first ground conductor, and a second ground conductor. The dielectric element body includes a signal conductor at the middle position of the thickness direction. The first ground conductor includes elongated conductors and bridge conductors. The elongated conductors are spaced in the width direction of the dielectric element body, and extend in the longitudinal direction. The bridge conductors connect the elongated conductors at spacings along the longitudinal direction. The spacing of bridge conductors across the bending point in a bent portion is smaller than the spacing of adjacent bridge conductors located in a straight portion.

15 Claims, 8 Drawing Sheets

FLAT CABLE AND ELECTRONIC APPARATUS

CROSS REFERENCE

This non-provisional application claims priority under 35 U.S.C. §119(a) to Patent Application No. 2012-147866 filed in Japan on Jun. 29, 2012, and Patent Application No. 2013-068343 filed in Japan on Mar. 28, 2013, the entire contents of which are hereby incorporated by reference.

BACKGROUND OF THE INVENTION

1. Field of the Invention

The present invention relates to a thin flat cable for transmitting high-frequency signals, and an electronic apparatus including the flat cable.

2. Description of the Related Art

In related art, coaxial cables are typically used as high-frequency lines for transmitting high-frequency signals. A coaxial cable includes a center conductor (signal conductor) that extends in one direction (extends in the direction of signal transmission), and a shield conductor that is provided concentrically along the outer peripheral surface of the center conductor.

Recent reductions in the size and thickness of high-frequency apparatuses including mobile communications terminals have led to cases where it is not possible to secure a space for arranging a coaxial cable inside a terminal housing.

Use of flat cables as disclosed in International Publication No. WO 2011/007660 and Japanese Registered Utility Model No. 3173143 for such a terminal housing is attracting attention. Although wider than a coaxial cable, a flat cable can be made thinner, which proves particularly advantageous for cases where there is only a narrow gap inside the terminal housing.

Each of the flat cables disclosed in International Publication No. WO 2011/007660 and Japanese Registered Utility Model No. 3173143 has a triplate strip line structure as its basic structure.

Each of the flat cables disclosed in International Publication No. WO 2011/007660 and Japanese Registered Utility Model No. 3173143 includes a flat-shaped dielectric element body having flexibility and insulating property. The dielectric element body has an elongated shape that extends in a straight line. A second ground conductor is located on a second surface that is orthogonal to the thickness direction of the dielectric element body. The second ground conductor is a so-called solid conductor pattern that covers substantially the entire second surface of a base material sheet. A first ground conductor is located on a first surface of the base material sheet opposite to the second surface. The first ground conductor includes two elongated conductors extending along the longitudinal direction, at both ends of the width direction orthogonal to the longitudinal direction and the thickness direction. The two elongated conductors are connected by bridge conductors. The bridge conductors are arranged at predetermined spacings along the longitudinal direction, and extend in the width direction. As a result, the second ground conductor has an array of openings having a predetermined length that are formed along the longitudinal direction. The bridge conductors for forming the openings are generally arranged at regular spacings along the longitudinal direction.

A signal conductor having a predetermined width and a predetermined thickness is formed in the middle of the thickness direction of the dielectric element body. The signal conductor has an elongated shape that extends in a direction parallel to the elongated conductor portion of the first ground conductor and the second ground conductor. The signal conductor is formed at substantially the center of the width direction of the dielectric element body.

When the flat cable configured as described above is seen in planar view (in a direction orthogonal to the first surface and the second surface), the signal conductor is arranged in such a way that the signal conductor overlaps the first ground conductor only at the location of the bridge conductors, and lies within each of the openings in other locations.

The flat cable described above has an elongated shape that extends in a straight line. Therefore, connection terminals to be connected by the flat cable described above can be connected to each other without any problem if these connection terminals are arranged on a straight line, and if there is no obstacle on this straight line.

However, if a component or area with which contact should be avoided exists on the straight line connecting the connection terminals, it is necessary to bend or curve the flat cable at some position along its length.

Such bending or curving causes hardly any adverse effect on the transmission of an RF signal if it is possible to make the radius of curvature larger than a predetermined value in accordance with the frequency of the RF signal to be transmitted. However, in this case, a space for realizing a large radius of curvature is required, which presents a problem for a structure that is to be arranged inside a mobile communications terminal for which miniaturization is required.

On the other hand, use of a bent flat cable that is bent at a predetermined angle (for example, 90°) presents the following problem.

In the bent portion, unlike in the straight portion at either end across the bent portion, signals are not transmitted in a TEM mode. Specifically, in the bent portion, signals are transmitted in a TE mode in which the magnetic field becomes dense on the inside of the bend and the magnetic field becomes sparse on the outside of the bend. For this reason, in the bent portion, characteristic impedance tends to vary greatly depending on the positional relationship between the signal conductor and the ground conductors. Therefore, because the bent portion tends to vary easily in shape owing to manufacturing variability or the like, the characteristic impedance of the bent portion tends to vary easily, and hence the characteristic impedance of the flat cable as a whole also tends to vary easily.

SUMMARY OF THE INVENTION

Accordingly, preferred embodiments of the present invention provide a flat cable that includes a bent portion, but is not susceptible to the influence of the shape of the bent portion, and has superior transmission characteristics.

According to a preferred embodiment of the present invention, a flat cable includes a dielectric element body that has a flat shape, the dielectric element body being bent at at least one bending position along a longitudinal direction, a signal conductor that is arranged in the dielectric element body, and extends along the longitudinal direction, and a first ground conductor that is located on a surface on one end side in a thickness direction of the dielectric element body, the first ground conductor extending along the longitudinal direction. The flat cable according to a preferred embodiment of the present invention has the following characteristic features.

The first ground conductor includes two elongated conductors that are spaced from each other, the two elongated conductors being arranged at both ends of a width direction, a plurality of bridge conductors that connect the two elongated conductors at spacings along the longitudinal direction, and an opening that is defined by the two elongated conductors and two of the bridge conductors. A spacing of two of the bridge conductors that define an opening including the bending position is narrower than a spacing of two of the bridge conductors that define an opening adjacent to at least one side of the opening including the bending position.

According to this configuration, the characteristic impedance in the bent portion, which is an area located between two bridge conductors across the bending position, can be corrected from the L property (inductive property) to the C property (capacitive property). As a result, it is possible to make the maximum value of the characteristic impedance in the bent portion smaller, and reduce the influence of variations in the characteristic impedance in the bent portion on the characteristic impedance and transmission characteristics of the flat cable.

The flat cable according to a preferred embodiment of the present invention is preferably configured as follows. The spacing of the two bridge conductors that define the opening including the bending position is narrower than both of spacings of two of the bridge conductors that define two openings adjacent to the opening including the bending position.

According to this configuration, it is possible to further reduce the influence of variations in characteristic impedance due to the bent portion, on the characteristic impedance of the flat cable.

The flat cable according to a preferred embodiment of the present invention is preferably configured as follows. The spacing of the two bridge conductors that define the opening including the bending position is narrower than an average of spacings of two of the bridge conductors that define all of openings that do not include the bending position.

According to this configuration, it is possible to reduce the influence of variations in characteristic impedance due to the bent portion, on the characteristic impedance of the flat cable more reliably.

The flat cable according to a preferred embodiment of the present invention is preferably configured so that a maximum value of a characteristic impedance in a bent portion which is determined by the opening including the bending position is not larger than a maximum value of a characteristic impedance which is determined by a spacing of the bridge conductors excluding the two bridge conductors that define the opening including the bending position.

According to this configuration, it is possible to reduce the occurrence of an unnecessary standing wave whose wavelength is determined by the point at which the characteristic impedance in the bent portion becomes the maximum.

The flat cable according to a preferred embodiment of the present invention is preferably configured so that the maximum value of the characteristic impedance in the bent portion is smaller than the maximum value of the characteristic impedance which is determined by the spacing of the bridge conductors excluding the two bridge conductors that define the opening including the bending position.

According to this configuration, the maximum value of the characteristic impedance in the bent portion is smaller than the maximum value of the characteristic impedance in the straight portion. Therefore, occurrence of a low-frequency standing wave due to the characteristic impedance in the bent portion can be reduced more reliably.

The flat cable according to a preferred embodiment of the present invention preferably further includes a second ground conductor that is located on substantially an entire surface on another end side in the thickness direction of the dielectric element body, and an interlayer connection conductor that connects the first ground conductor and the second ground conductor.

According to this configuration, a so-called triplate transmission line can be realized, and moreover unnecessary radiation can be reduced.

The flat cable according to a preferred embodiment of the present invention is preferably configured so that a spacing of the two elongated conductors that define the first ground conductor is wider at a middle position between two of the bridge conductors that are adjacent to each other, than at a position where the two elongated conductors are connected by each of the bridge conductors.

According to this configuration, it is possible to prevent characteristic impedance from changing abruptly and greatly along the longitudinal direction in the area sandwiched by the bridge conductors, and improve transmission characteristics.

The flat cable according to a preferred embodiment of the present invention is preferably configured so that a width of the signal conductor is larger at a middle position between two of the bridge conductors that are adjacent to each other, than at a position where the signal conductor overlaps each of the bridge conductors.

According to this configuration, the RF resistance of the signal conductor is reduced so as to reduce the conductor loss of the flat cable.

The flat cable according to a preferred embodiment of the present invention may further include a connector member that connects to the signal conductor, the connector member being provided at at least one end of the longitudinal direction.

According to this configuration, the provision of the connector member enables easy connection of the flat cable to an external circuit board or the like.

Another preferred embodiment of the present invention provides an electronic apparatus, and includes the following characteristic features. That is, the electronic apparatus includes the flat cable according to any one of the configurations of the various preferred embodiments of the present invention described above, a plurality of mounting circuit boards that are connected by the flat cable, and a housing that contains the mounting circuit boards.

This configuration relates to an electronic apparatus that uses the above-mentioned flat cable. Use of the above-mentioned flat cable makes it possible to transfer RF signals between the mounting circuit boards located inside the housing, without increasing transmission loss irrespective of how the mounting circuit boards are connected.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
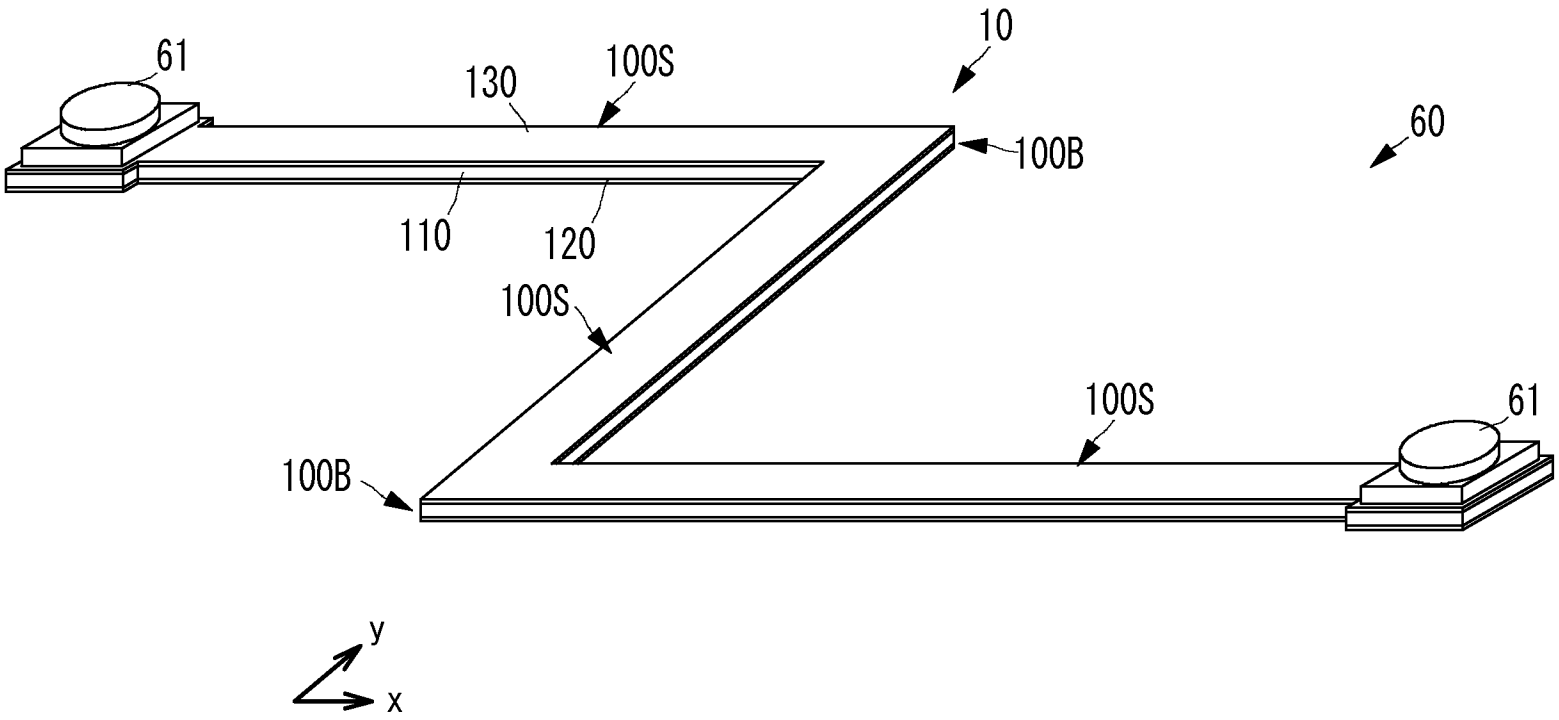
FIG. 1 is a perspective view of the outward appearance of a flat cable according to a first preferred embodiment of the present invention.
Figure 2A:
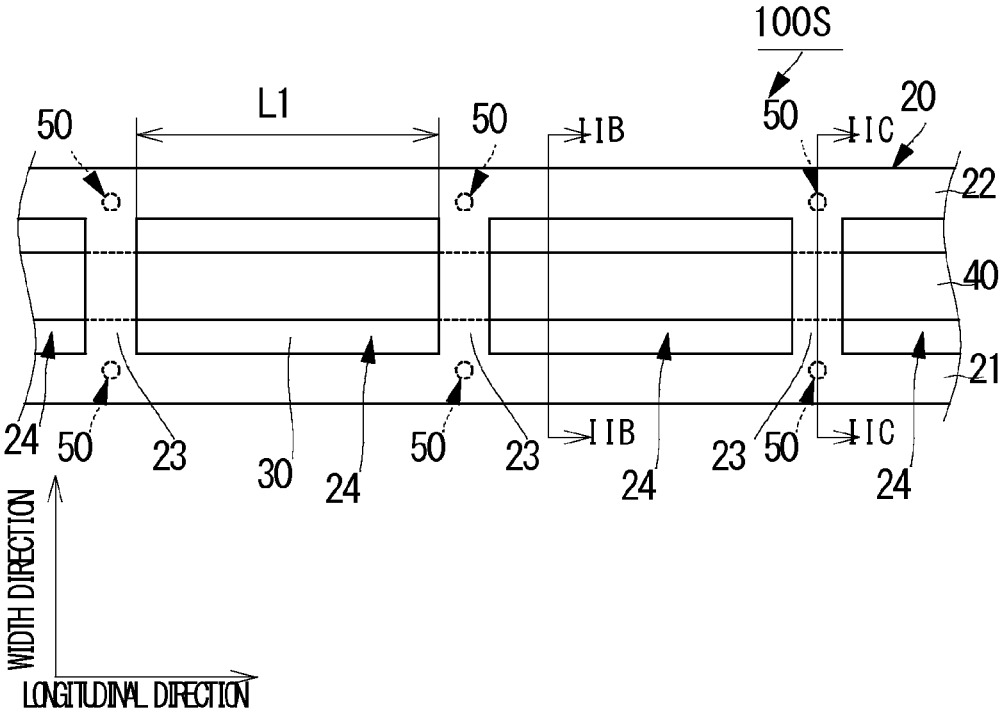
FIGS. 2A to 2C illustrate the structure of a straight portion of a transmission line portion.
Figure 2B:
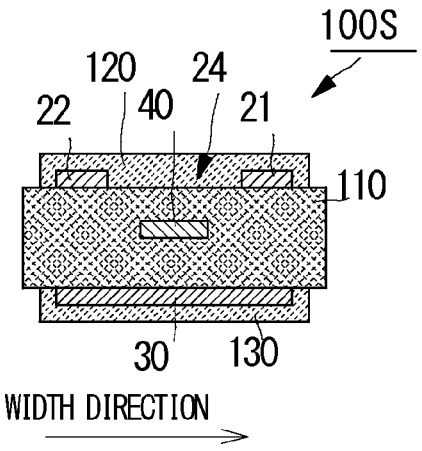
Figure 2C:
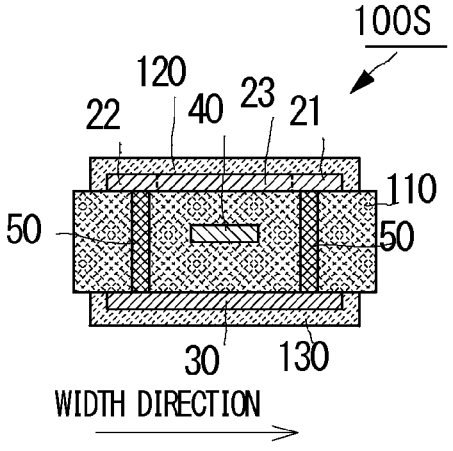
Figure 3:
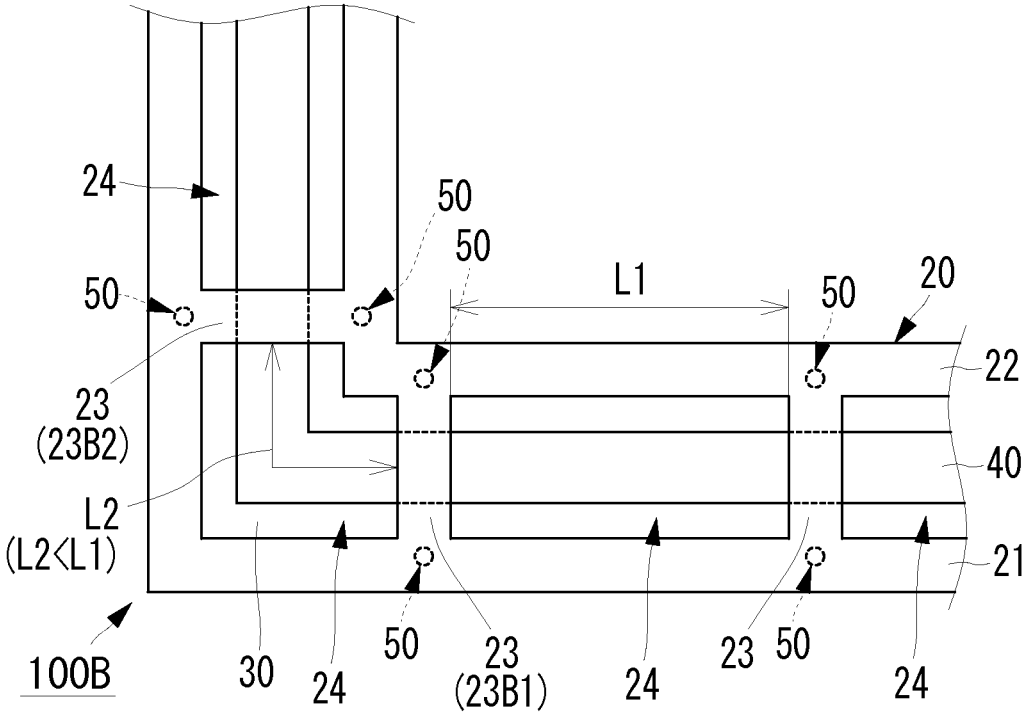
FIG. 3 illustrates the structure of the straight portion of the transmission line portion.

A flat cable according to a first preferred embodiment of the present invention will be described with reference to the drawings. FIG. 1 is a perspective view of the outward appearance of a flat cable 60 according to the first preferred embodiment of the present invention. FIGS. 2A to 2C illustrate the structure of a straight portion 100S of a transmission line portion 10. FIG. 2A is a plan view, as seen from the first principal surface side, of the straight portion 100S in a state in which a dielectric element body 110 is omitted. FIG. 2B is a cross-sectional view taken along a line IIB-IIB of FIG. 2A. FIG. 2C is a cross-sectional view taken along a line IIC-IIC of FIG. 2A. FIG. 3 illustrates the structure of a bent portion 100B of the transmission line portion 10. FIG. 3 is a plan view, as seen from the first principal surface side, of the bent portion 100B in a state in which the dielectric element body 110 is omitted.

The flat cable 60 includes the transmission line portion 10, and two coaxial connectors 61. The transmission line portion 10 has a flat and elongated shape. The transmission line portion 10 is bent at two positions along the longitudinal direction. Each of the two coaxial connectors 61 is located at either end in the longitudinal direction of the transmission line portion 10. The coaxial connectors 61 are located on the first principal surface side of the transmission line portion 10. A center conductor (not illustrated) of each of the coaxial connectors 61 is connected to an end portion of a signal conductor 40 (see FIGS. 2A to 2C and FIG. 3) of the transmission line portion 10. An external conductor (not illustrated) of each of the coaxial connectors 61 is connected to a first ground conductor 20 of the transmission line portion 10. The coaxial connectors 61 may be omitted, and may not be in the form of connectors that are coaxial. In a case where the coaxial connectors 61 are omitted, the signal conductor 40, or the first ground conductor 20 and a second ground conductor 30 in the vicinity of either end of the transmission line portion 10 may be exposed to the outside. Moreover, the coaxial connectors 61 may be located on different surfaces. For example, the coaxial connector 61 at one end may be located on the first principal surface side, and the coaxial connector 61 on the other end side may be located on the second principal surface side.

The outward appearance of the transmission line portion is such that the dielectric element body 110 having a flat shape is sandwiched by a protective layer 120 and a protective layer 130 from both ends in the thickness direction of the dielectric element body 110. Specifically, on the side of a first principal surface that is one end surface in the thickness direction of the dielectric element body 110, the protective layer 120 is arranged over substantially the entire surface of the dielectric element body 110. On the side of a second principal surface that is the other end surface in the thickness direction of the dielectric element body 110, the protective layer 130 is arranged over substantially the entire surface of the dielectric element body 110.

The transmission line portion 10 includes straight portions 100S provided in three locations which are connected by bent portions 100B provided in two locations. The longitudinal direction of the straight portions 100S at both ends of the longitudinal direction of the transmission line portion 10 is along an x-direction that is a first direction parallel or substantially parallel to the first principal surface and the second principal surface. The longitudinal direction of the straight portion 100S in the middle is along a y-direction that is a second direction parallel or substantially parallel to the first principal surface and the second principal surface and orthogonal to the x-direction. The bent portions 100B are connected between the straight portions 100S provided in these three locations. The straight portions 100S and the bent portions 100B are preferably formed integrally.

The specific shapes of the straight portion 100S and bent portion 100B will be described with reference to FIGS. 2A to 2C and FIG. 3.

Each of the straight portion 100S includes a straight portion of the dielectric element body 110 that has a flat shape. Each of the bent portion 100B has a bent portion of the dielectric element body 110 that has a flat shape. The dielectric element body 110 is made of, for example, a material having flexibility such as polyimide or liquid crystal polymer.

The signal conductor 40 is preferably in the form of a flat film. The signal conductor 40 is located at substantially the center of the width direction of the dielectric element body 110. The width of the signal conductor 40 is smaller than the width of the dielectric element body 110. More specifically, the width of the signal conductor 40 is smaller than the spacing in the width direction between elongated conductors 21 and 22 described later that define the first ground conductor 20. The signal conductor 40 is located at a predetermined position closer to the first ground conductor 20 side than the middle position of the thickness direction of the dielectric element body 110. The position of the signal conductor 40 in the thickness direction is set so that a desired characteristic impedance is obtained for the transmission line portion 10. The signal conductor 40 is made of a material having high electrical conductivity, for example, copper (Cu).

The first ground conductor 20 is located on the first principal surface (corresponding to a surface on one end side according to a preferred embodiment of the present invention) of the dielectric element body 110. The first ground conductor 20 includes the elongated conductors 21 and 22, and a plurality of bridge conductors 23 (including bridge conductors 23B1 and 23B2). The first ground conductor 20 is also made of a material having high electrical conductivity, for example, copper (Cu).

The elongated conductors 21 and 22 have an elongated shape that extends along the longitudinal direction of the dielectric element body 110. The elongated conductor 21 is located at one end in the width direction of the dielectric element body 110, and the elongated conductor 22 is located at the other end in the width direction of the dielectric element body 110. The elongated conductors 21 and 22 are arranged at a predetermined spacing, along the width direction of the dielectric element body 110.

The bridge conductors 23 extend in the width direction of the dielectric element body 110. The bridge conductors 23 are arranged at spacings along the longitudinal direction of the dielectric element body 110. Consequently, as viewed in a direction perpendicular or substantially perpendicular to the first principal surface (as viewed along the thickness direction), an opening 24 is located between the bridge conductors 23.

The first ground conductor 20 preferably has a ladder-shaped configuration that extends in the longitudinal direction.

The second ground conductor 30 is located on the second principal surface of the dielectric element body 110. The second ground conductor 30 is arranged over substantially the entire surface of the dielectric element body 110. The second ground conductor 30 is also made of a material having high electrical conductivity, for example, copper (Cu).

The first ground conductor 20 and the second ground conductor 30 are connected by an interlayer connection conductor 50. The interlayer connection conductor 50 is a so-called conductive via-conductor, which penetrates the dielectric element body 110 in the thickness direction. The interlayer connection conductor 50 is located at a position in the first ground conductor 20 where each of the elongated conductors 21 and 22 and each of the bridge conductors 23 connect to each other.

A non-limiting example of how to form the interlayer connection conductor 50 will be described. First, a through-hole is formed with a laser or punch in a required position of a plurality of insulating films that form the dielectric element body 110. Then, the through-hole thus formed is filled with a conductive paste (including, for example, silver (Ag) as its main component). Then, the plurality of insulating films are stacked on top of one another, and heat-bonded to form the dielectric element body 110. At this time, the conductive paste that has been filled into the through-hole turns into a metal, and becomes the interlayer connection conductor 50 that is a conductive via-conductor. In this way, turning of the conductive paste into a metal may be performed simultaneously with heat-bonding of the dielectric element body 110.

The above-mentioned configuration makes it possible to realize a so-called triplate transmission line in which the signal conductor 40 located inside the dielectric element body 110 is sandwiched by the first ground conductor 20 and the second ground conductor 30.

In the triplate transmission line formed in this way, as mentioned above, the protective layer 120 is formed on the first principal surface side of the dielectric element body 110, and the protective layer 130 is formed on the second principal surface side of the dielectric element body 110. As a result, the transmission line portion 10 according to the first preferred embodiment is realized.

In the transmission line portion 10 according to the first preferred embodiment, the spacing of the bridge conductors 23 differs between the straight portion 100S and the bent portion 100B. As illustrated in FIG. 2A and FIG. 3, let L1 be the spacing of the bridge conductors 23 in the straight portion 100S. Also, let L2 be the spacing of the bridge conductors 23B1 and 23B2 in the bent portion 100B. In this case, as illustrated in FIG. 3, the spacing L2 of the bridge conductors in the bent portion 100B is the length between the bridge conductor 23B1 and the bridge conductor 23B2 that are located on opposite sides of the bending point of the transmission line portion 10 and closet to the bending point in the longitudinal direction. This length is set along the centerline in the width direction of the signal conductor 40.

The spacing L2 of the bridge conductors in the bent portion 100B is shorter than the spacing L1 of the bridge conductors in the straight portion 100S. This structure provides the operational effects as described below.

Figure 4:
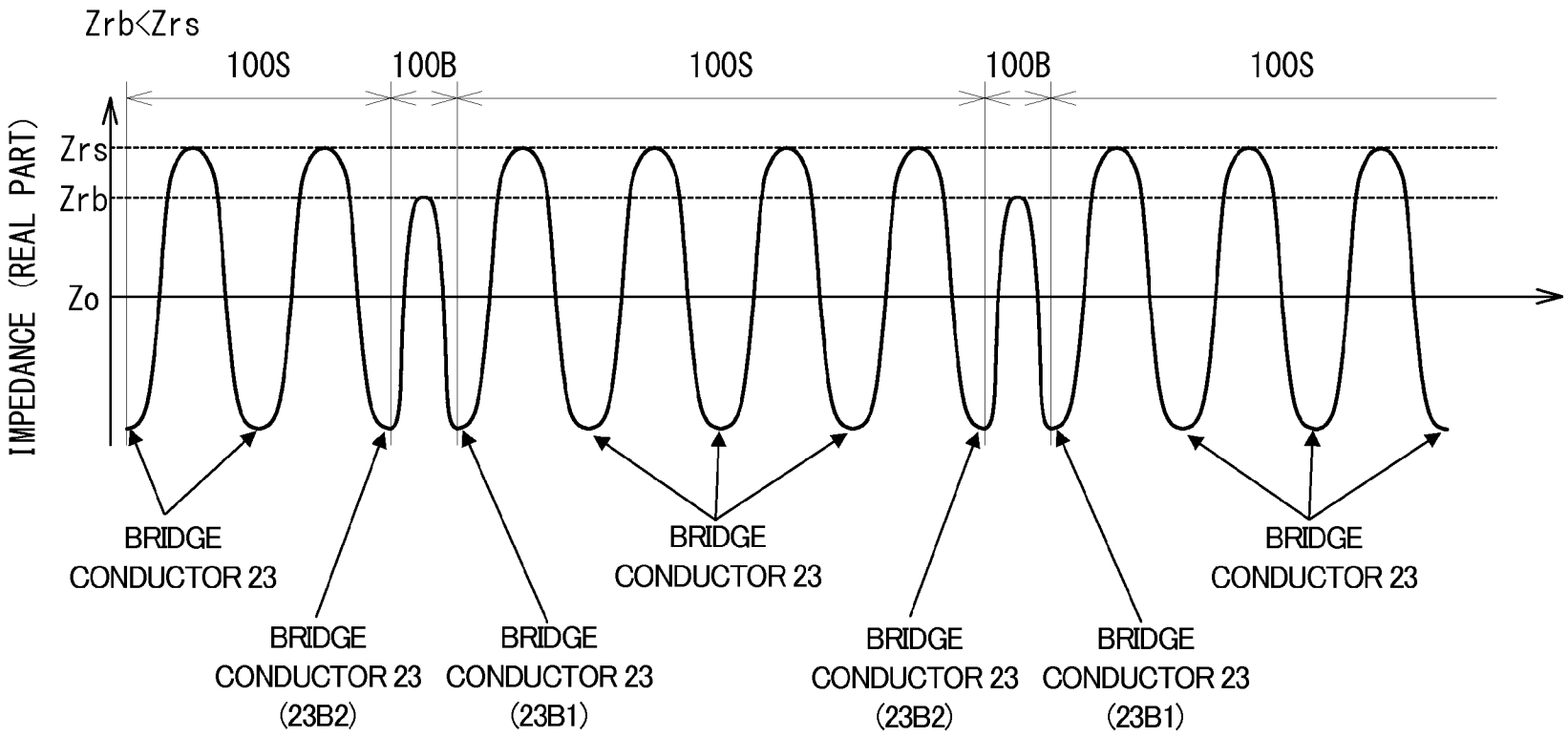
FIG. 4 is a graph illustrating the distribution characteristics of characteristic impedance along the longitudinal direction of the transmission line portion of the flat cable according to the first preferred embodiment of the present invention.

FIG. 4 is a graph illustrating the distribution characteristics of characteristic impedance along the longitudinal direction of the transmission line portion 10 of the flat cable 60 according to the first preferred embodiment.

In the straight portion 100S, characteristic impedance varies in a period corresponding to the spacing of the bridge conductors 23. The real part of the characteristic impedance becomes a maximum value Zrs at the middle position between the bridge conductors 23 along the longitudinal direction, in other words, at the middle position of the opening 24 along the longitudinal direction. Because the spacing of the bridge conductors 23 is constant in the straight portion 100S, the maximum value of the real part of the characteristic impedance is Zrs throughout the straight portion 100S. The spacing of the bridge conductors 23 (the length along the longitudinal direction of the opening 24) in the straight portion 100S is set so that the wavelength of an unnecessary standing wave caused by the spacing between the maximum points of this characteristic impedance is sufficiently shorter than the wavelength of the RF signal transmitted by the transmission line portion 10, for example, shorter than the second order harmonic or third order harmonic of the RF signal.

The spacing L2 of the bridge conductors 23B1 and 23B2 in the bent portion 100B is shorter than the spacing L1 in the straight portion 100S. Consequently, in the bent portion 100B, the C property (capacitive property) can be made stronger than in the straight portion 100S, without causing the L property (inductive property) to become strong. Therefore, the maximum value Zrb of the real part of the characteristic impedance of the bent portion 100B can be made smaller than the maximum value Zrs of the real part of the characteristic impedance of the straight portion 100S.

According to this configuration, as the characteristic impedance of the transmission line portion 10, the characteristic impedance of the straight portion 100S becomes dominant. That is, the characteristic impedance of the transmission line portion 10 is determined primarily by the characteristic impedance of the straight portion 100S. Accordingly, even when the characteristic impedance of the bent portion 100B, which tends to easily vary in shape owing to manufacturing variability, varies owing to the manufacturing variability, the variation has only a small influence on the overall characteristic impedance of the transmission line portion 10. As a result, it is possible to reduce the influence of manufacturing variability, and realize the transmission line portion 10 that ensures stable characteristic impedance.

The ability to realize such a characteristic impedance relationship between the bent portion 100B and the straight portion 100S prevents occurrence of an unnecessary standing wave between the point at which the real part of the characteristic impedance of the bent portion 100B becomes the maximum value Zrb as one end, and another point at which the characteristic impedance of the flat cable 60 is high as the other end, or an unnecessary standing wave between adjacent bent portions 100B as both ends. Such an unnecessary standing wave has a large wavelength, which may sometimes become close to the wavelength of a RF signal, for example. However, the configuration according to the first preferred embodiment makes it possible to reduce occurrence of such an unnecessary standing wave with a wavelength close to the wavelength of a RF signal. As a result, the transmission characteristics of the transmission line portion 10 can be improved.

While the first preferred embodiment mentioned above is preferably directed to the case where the transmission line portion 10 is bent at 90°, or approximately 90°, for example, the configuration according to the first preferred embodiment can be applied to any bent shape or curved shape that causes the TEM mode to change to the TE mode when a RF signal is transmitted from the straight portion to the bent portion. In that case, the same operational effects as those of the first preferred embodiment can be attained.

Figure 5A:
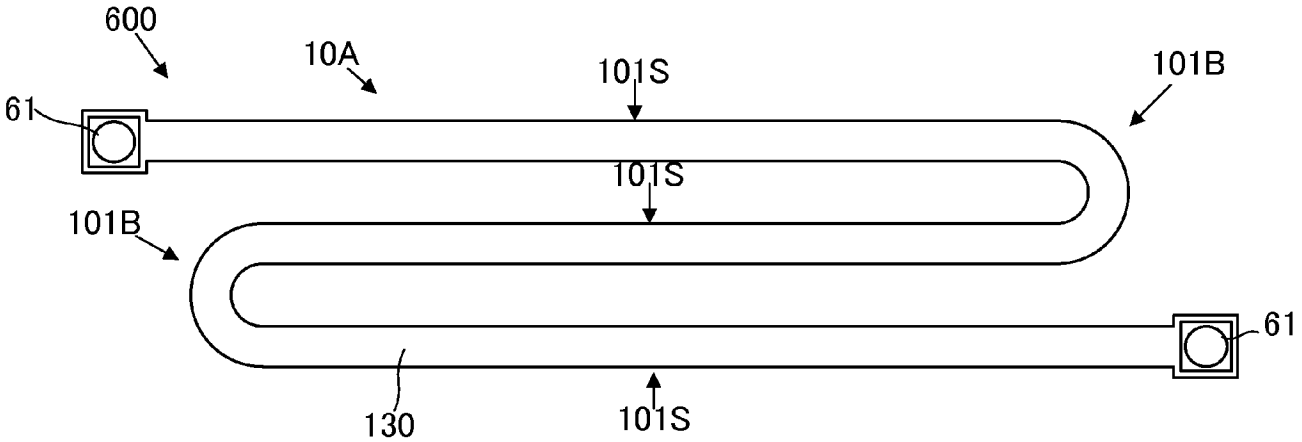
FIGS. 5A and 5B illustrate a flat cable according to a modification of a preferred embodiment of the present invention.
Figure 5B:
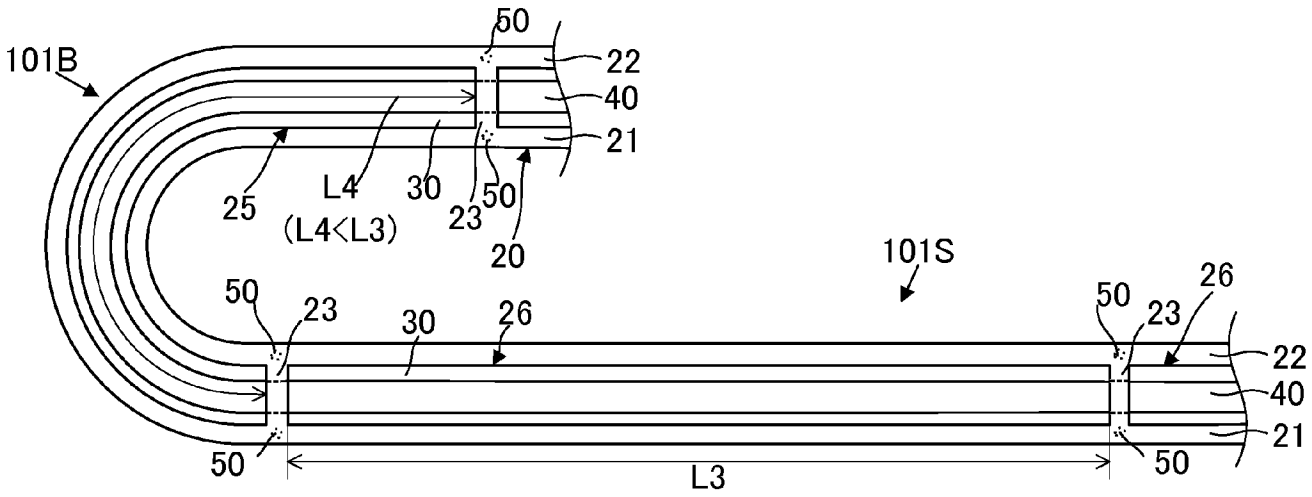

FIG. 5A is a plan view of a flat cable 600 including a bent portion 101B according to a modification of the flat cable 60 of a preferred embodiment of the present invention. FIG. 5B illustrates the structure of the bent portion 101B and a straight portion 101S of a transmission line portion 10A. As illustrated in FIG. 5A, the flat cable 600 differs from the flat cable 60 in that the bent portion 101B has a curved shape. A description of overlapping components will be omitted.

The transmission line portion 10A includes bent portions 101B provided in two locations and straight portions 101S provided in three locations, which are alternately connected to each other. The straight portion 101S has the same structure as the straight portion 100S mentioned above. In the bent portion 101B, the transmission line portion 10A is bent so that its direction of extension turns (for example, at 180°).

Each of the first ground conductor 20, the elongated conductors 21 and 22, the second ground conductor 30, the signal conductor 40, and the protective layers 120 and 130 has a shape (bent shape) that conforms to the shape of the transmission line portion 10A. The layer structure in the thickness direction is the same as that of the straight portion 101S.

A spacing L4 of the bridge conductors 23 in the bent portion 101B is shorter than a spacing L3 of the bridge conductors 23 in the straight portion 101S.

According to this configuration, in the bent portion 101B of the transmission line portion 10A, the C property (capacitance) becomes stronger, that is, impedance can be made smaller than in the straight portion 101S so as to improve transmission characteristics.

A flat cable having such a structure is manufactured as described below, for example.

First, a first insulating film with copper on both sides, and a second insulating film with copper on one side are prepared.

The first ground conductor 20 is formed preferably by patterning on the first principal surface side of the first insulating film. The signal conductor 40 is formed preferably by patterning on the second principal surface side of the first insulating film. A plurality of pairs of the first ground conductors 20 and the signal conductors 40 are formed in an array on the first insulating film.

The second ground conductor 30 is formed preferably by patterning on the second principal surface side of the second insulating film. A plurality of the second ground conductors 30 are formed in an array on the second insulating film.

The first insulating film and the second insulating film are bonded together in such a way that each of the first ground conductors 20 and each of the second ground conductors 30 are opposed to each other. At this time, the first insulating film and the second insulating film are bonded together in such a way that the signal conductors 40 are arranged between the first insulating film and the second insulating film. As a result, a plurality of composites are obtained, each of which has the first ground conductor 20 and the second ground conductor 30 formed on both sides of a dielectric element body including the signal conductor 40 provided at the middle position of the thickness direction.

Individual transmission line portions 10 are cut out from the composites. The protective layers 120 and 130 are formed on the transmission line portion 10. The coaxial connectors 61 are located at both ends in the longitudinal direction of the transmission line portion 10, and on the side of the surface on which the protective layer 130 is located.

Figure 6A:
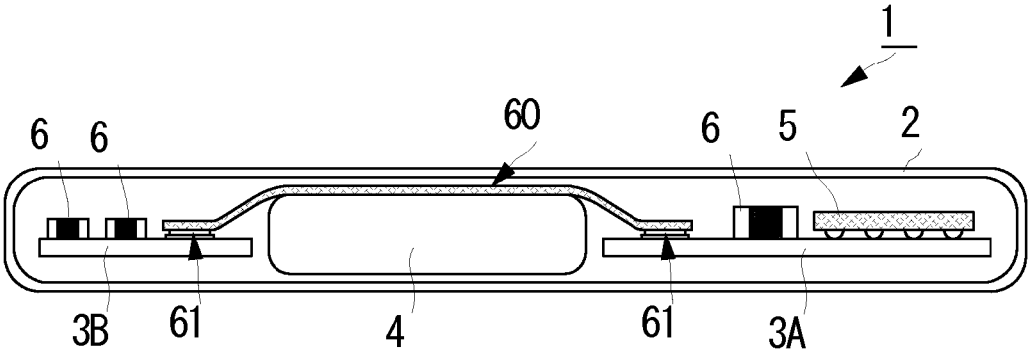
FIGS. 6A and 6B are a side cross-sectional view and a plan cross-sectional view, respectively, illustrating the configuration of the components of a portable electronic apparatus according to the first preferred embodiment of the present invention.
Figure 6B:
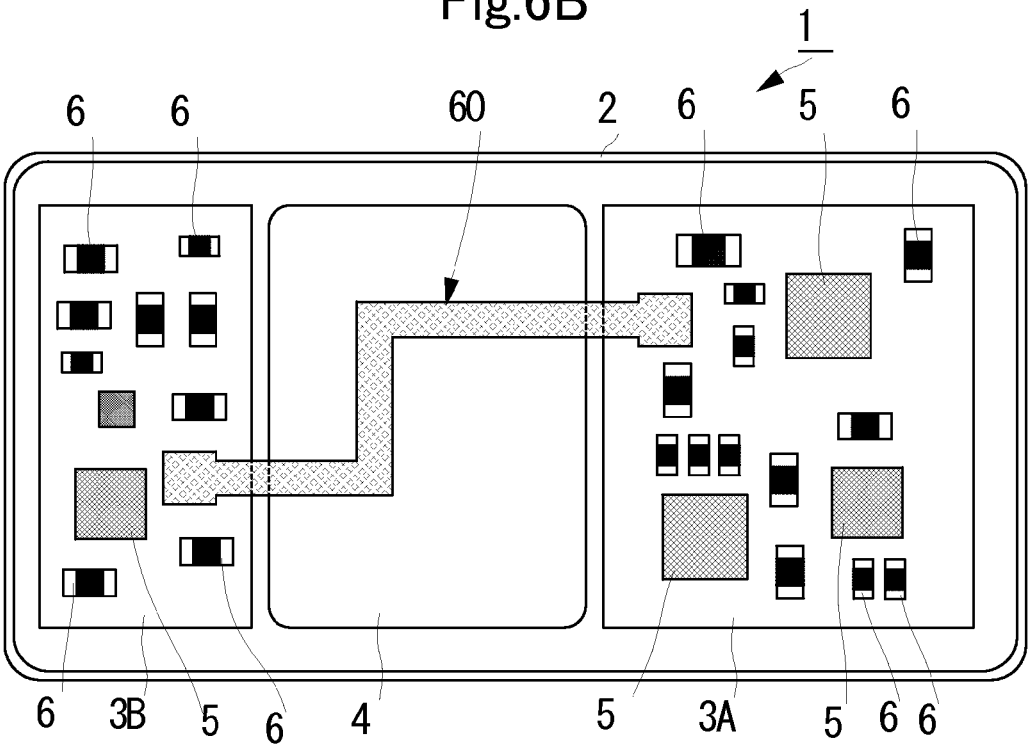

The flat cable 60 having the above-mentioned structure can be used for a portable electronic apparatus described below, for example. FIG. 6A is a side cross-sectional view illustrating the configuration of the components of a portable electronic apparatus according to the first preferred embodiment of the present invention. FIG. 6B is a plan cross-sectional view illustrating the configuration of the components of the portable electronic apparatus.

A portable electronic apparatus 1 includes a thin apparatus housing 2. Mounting circuit boards 3A and 3B, and a battery pack 4 are arranged inside the apparatus housing 2. A plurality of IC chips 5 and mounting components 6 are mounted on the surfaces of the mounting circuit boards 3A and 3B. The mounting circuit boards 3A and 3B, and the battery pack 4 are placed inside the apparatus housing 2 so that when the apparatus body 2 is seen in planar view, the battery pack 4 is arranged between the mounting circuit boards 3A and 3B. Because the apparatus housing 2 is preferably as thin as possible, in the thickness direction of the apparatus housing 2, the space between the battery pack 4 and the apparatus housing 2 is very narrow. Therefore, it is not possible to arrange a coaxial cable in the space between the battery pack 4 and the apparatus housing 2.

However, by arranging the flat cable 60 according to the first preferred embodiment in such a way that the thickness direction of the flat cable 60 and the thickness direction of the apparatus housing 2 coincide, the flat cable 60 can be passed between the battery pack 4 and the apparatus housing 2. As a result, the mounting circuit boards 3A and 3B, which are separated from each other with the battery pack 4 in the middle, can be connected by the flat cable 60.

Further, as described above with reference to the first preferred embodiment, the flat cable 60 is bent in the middle of the longitudinal direction. Accordingly, even if there is a restriction that does not allow the flat cable to be wired in the form of a straight line connecting the connection terminal of the flat cable 60 on the mounting circuit board 3A and the connection terminal of the flat cable 60 on the mounting circuit board 3B (for example, in the case of FIGS. 6A and 6B, if electronic components are mounted on the surface of the battery pack 4), the mounting circuit boards 3A and 3B can be connected to each other. Moreover, even if the flat cable 60 has such a bent shape, using the configuration according to the first preferred embodiment makes it possible to reduce transmission loss due to the flat cable 60 between the mounting circuit boards 3A and 3B.

Figure 7:
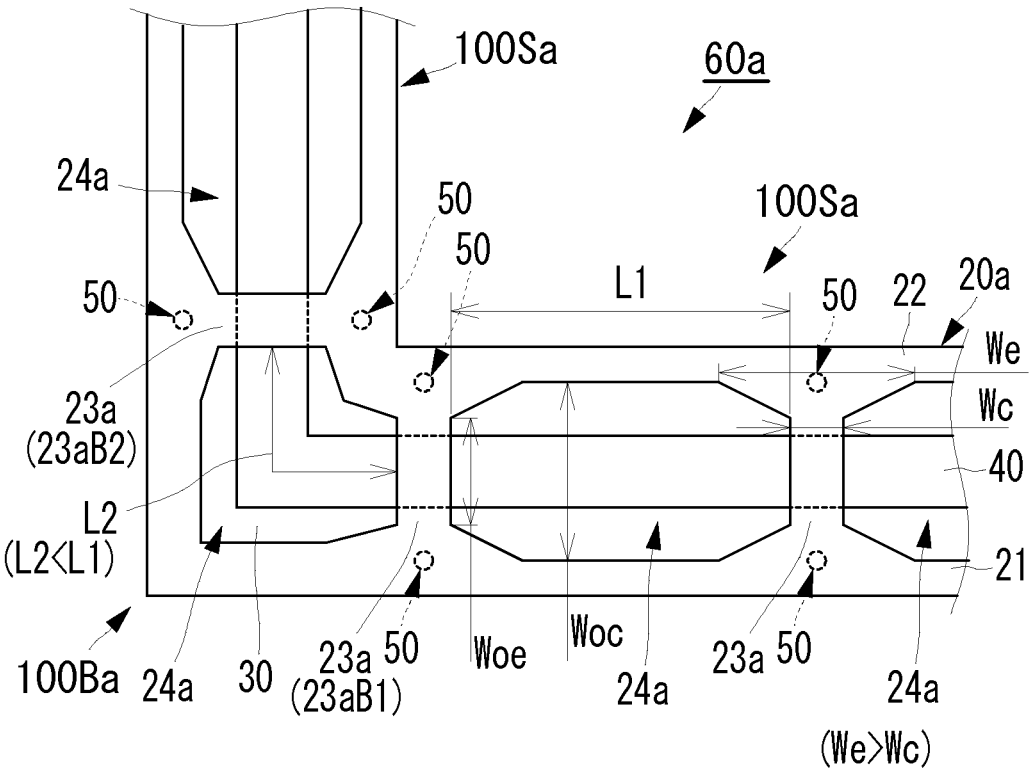
FIG. 7 is an enlarged plan view illustrating the vicinity of a bent portion of a flat cable according to a second preferred embodiment of the present invention.

Next, a flat cable according to a second preferred embodiment of the present invention will be described with reference to a drawing. FIG. 7 is an enlarged plan view illustrating the vicinity of a bent portion 100Ba of the flat cable according to the second preferred embodiment of the present invention. In FIG. 7, the dielectric element body is omitted.

A flat cable 60*a* according to the second preferred embodiment differs from the flat cable 60 according to the first preferred embodiment in the structure of a first ground conductor 20*a*. The configuration of the flat cable 60*a* is otherwise preferably the same or substantially the same as that of the flat cable 60 according to the first preferred embodiment. Accordingly, only differences will be described.

The first ground conductor 20*a* has the elongated conductor 21 and the elongated conductor 22 that are connected by bridge conductors 23*a* (including bridge conductors 23*a*B1 and 23*a*B2). The shape of each of the bridge conductors 23*a* is such that its width near the end portion connected to each of the elongated conductors 21 and 22 becomes larger with increasing proximity to the end portion. That is, letting Wc be the width near the center of each of the bridge conductors 23*a*, and We be the width of the end portion of each of the bridge conductors 23*a*, Wc<We. The width of each of the bridge conductors 23*a* gradually increases from Wc to We with increasing proximity to the end portion.

Owing to this structure, the opening width Woe of the opening 24*a* at the longitudinal end portion that contacts each of the bridge conductors 23*a* is smaller than the opening width Woc of the opening 24*a* at the middle position between the bridge conductors 23*a* along the longitudinal direction. The opening width of the opening 24*a* becomes gradually larger from the end portion that contacts each of the bridge conductors 23*a* toward its middle position. Moreover, the spacing between the elongated conductor 21 and the elongated conductor 22 (the opening width Woc of the opening 24*a*) is wider than the spacing between the elongated conductor 21 and the elongated conductor 22 in the first preferred embodiment.

The above-mentioned structure in which the width of the opening gradually increases with increasing distance from each of the bridge conductors is applied not only to a straight portion 100Sa but also to the bent portion 100Ba.

According to this configuration, the characteristic impedance in the opening changes as small, medium, large, medium, and small along the longitudinal direction. This reduces an abrupt change in characteristic impedance between the position where each of the bridge conductors 23*a* is located, and the opening 24*a*.

As a result, it is possible to realize a flat cable with even more superior transmission characteristics.

Figure 8:
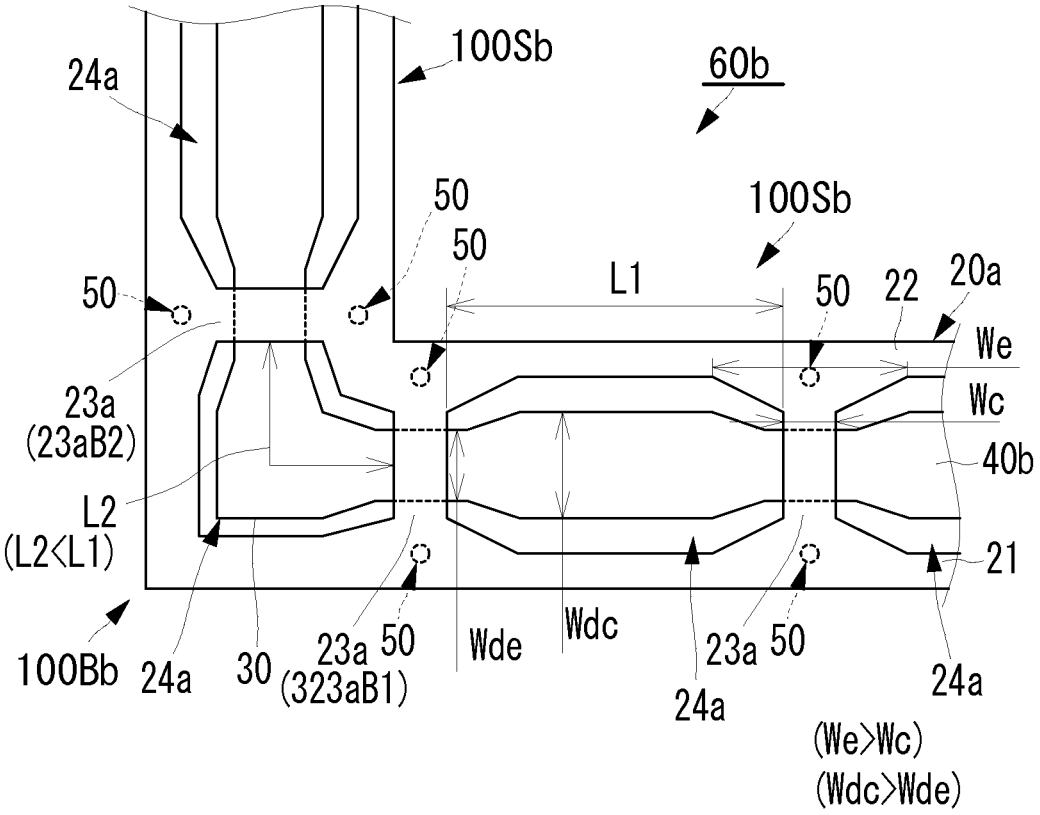
FIG. 8 is an enlarged plan view illustrating the vicinity of a bent portion of a flat cable according to a third preferred embodiment of the present invention.

Next, a flat cable according to a third preferred embodiment of the present invention will be described with reference to a drawing. FIG. 8 is an enlarged plan view illustrating the vicinity of a bent portion 100Bb of the flat cable according to the third preferred embodiment of the present invention. In FIG. 8, the dielectric element body is omitted.

A flat cable 60*b* according to the third preferred embodiment differs from the flat cable 60*a* according to the second preferred embodiment in the shape of a signal conductor 40*b*. The configuration of the flat cable 60*b* is otherwise preferably the same or substantially the same as that of the flat cable 60*a* according to the second preferred embodiment. Accordingly, only differences will be described.

As viewed in a direction perpendicular or substantially perpendicular to the first principal surface, the signal conductor 40*b* has a small width Wde in the portion that overlaps each of the bridge conductors 23*a*, and a large width Wdc in the portion that is arranged in the central area of the opening 24*a*. That is, Wdc>Wde. In addition, the width of the signal conductor 40*b* gradually increases from the position where the signal conductor 40*b* overlaps each of the bridge conductors 23*a* toward the central area of the opening 24*a*.

The above-mentioned structure in which the width Wde of the portion overlapping each of the bridge conductors 23*a* is small, and the width Wdc in the portion arranged in the central portion of the opening 24*a* is large applies not only to a straight portion 100Sb but also to the bent portion 100Bb.

This structure makes it possible to reduce the RF resistance of the signal conductor 40*b*. As a result, conductor loss can be reduced so as to make it possible to realize a flat cable with even more superior transmission characteristics.

While the above-mentioned preferred embodiments are directed to the case where the spacing of the bridge conductors is constant in the straight portion, the spacing of the bridge conductors may not be constant. In this case, the average of the spacings of the bridge conductors in the straight portion may be made wider than the spacing of the bridge conductors in the bent portion. As a result, the same operational effects as those of the above-mentioned preferred embodiments can be obtained.

The above-mentioned preferred embodiments are directed to the configuration in which the spacing of the bridge conductors in the straight portion is constant, and the spacing of the bridge conductors in the bent portion is shorter than the spacing of the bridge conductors in the straight portion. However, it suffices that the spacing of the bridge conductors in the bent portion be at least narrower than the spacing of the bridge conductors that define each of the openings (within the straight portion) adjacent to the opening in the bent portion. At this time, it suffices that the spacing of the bridge conductors in the bent portion be narrower than the spacing of the bridge conductors that define at least one of the openings on both sides of the opening in the bent portion. In this case, it is more preferable if the spacing of the bridge conductors in the bent portion is narrower than the spacings of the bridge conductors that define the openings on both sides of the bent portion. This configuration also makes it possible to reduce the influence of variations in characteristic impedance in the bent portion due to manufacturing variability, on variations in characteristic impedance in the transmission line portion.

While the above-mentioned preferred embodiments are preferably directed to the case where the maximum value of the real part of the characteristic impedance in the bent portion is smaller than the maximum value of the real part of the characteristic impedance in the straight portion, these two maximum values may be set to be the same. It is to be noted, however, that characteristic impedance varies owing to manufacturing variability, and especially the characteristic impedance in the bent portion tends to vary easily. Therefore, the spacing of the bridge conductors in the bent portion may be determined so that the maximum value of the real part of the characteristic impedance in the bent portion does not become larger than the maximum value of the real part of the characteristic impedance in the straight portion, even when such variations in characteristic impedance occur.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A flat cable comprising:

a dielectric element body that has a flat shape, the dielectric element body being bent at at least one bending position along a longitudinal direction;

a signal conductor that is arranged in the dielectric element body and extends along the longitudinal direction; and a first ground conductor that is located on a surface on one end side in a thickness direction of the dielectric element body, the first ground conductor extending along the longitudinal direction; wherein the first ground conductor includes:

two elongated conductors that are spaced from each other, the two elongated conductors being arranged at both ends along a width direction of the first ground conductor;

a plurality of bridge conductors that connect the two elongated conductors at spacings along the longitudinal direction; and an opening that is defined by the two elongated conductors and two of the bridge conductors; and a spacing of two of the bridge conductors that define an opening including the bending position is narrower than a spacing of two of the bridge conductors that define an opening adjacent to at least one side of the opening including the bending position.

2. The flat cable according to claim 1, wherein the spacing of the two bridge conductors that define the opening including the bending position is narrower than both of spacings of two of the bridge conductors that define two openings adjacent to the opening including the bending position.

3. The flat cable according to claim 1, wherein the spacing of the two bridge conductors that define the opening including the bending position is narrower than an average of spacings of two of the bridge conductors that define all of openings that do not include the bending position.

4. The flat cable according to claim 1, wherein a maximum value of a characteristic impedance in a bent portion which is determined by the opening including the bending position is not larger than a maximum value of a characteristic impedance which is determined by a spacing of the bridge conductors excluding the two bridge conductors that define the opening including the bending position.

5. The flat cable according to claim 4, wherein the maximum value of the characteristic impedance in the bent portion is smaller than the maximum value of the characteristic impedance which is determined by the spacing of the bridge conductors excluding the two bridge conductors that define the opening including the bending position.

6. The flat cable according to claim 1, further comprising:

a second ground conductor that is arranged on substantially an entire surface on another end side in the thickness direction of the dielectric element body; and an interlayer connection conductor that connects the first ground conductor and the second ground conductor.

7. The flat cable according to claim 1, wherein a spacing of the two elongated conductors that define the first ground conductor is wider at a middle position between two of the bridge conductors that are adjacent to each other, than at a position where the two elongated conductors are connected by each of the bridge conductors.

8. The flat cable according to claim 1, wherein a width of the signal conductor is larger at a middle position between two of the bridge conductors that are adjacent to each other, than at a position where the signal conductor overlaps each of the bridge conductors.

9. The flat cable according to claim 1, further comprising a connector member that is connected to the signal conductor, the connector member being provided at at least one end in the longitudinal direction.

10. An electronic apparatus comprising:

the flat cable according to claim 1;

a plurality of mounting circuit boards that are connected by the flat cable; and a housing that contains the plurality of mounting circuit boards.

11. The flat cable according to claim 1, wherein the dielectric element body is bent at at least two bending positions along the longitudinal direction.

12. The flat cable according to claim 1, wherein a portion of the dielectric element body that is bent has a flat shape.

13. The flat cable according to claim 1, further comprising two coaxial connectors located at at least one end in the longitudinal direction.

14. The flat cable according to claim 1, wherein the dielectric element body includes three straight portions and two bent portions disposed between the three straight portions.

15. The flat cable according to claim 14, wherein the three straight portions have a flat shape.

* * * * *